United States Patent [19]

Kando et al.

[11] 4,078,109

[45] Mar. 7, 1978

[54] BUTT-JOINED CARPET CONSTRUCTION WITH STRINGER TAPES

[75] Inventors: Akiyoshi Kando, Uozu; Kiyoo Yoneya, Kurobe, both of Japan

[73] Assignee: Yoshida Kogyo K.K., Japan

[21] Appl. No.: 788,917

[22] Filed: Apr. 19, 1977

[30] Foreign Application Priority Data

Apr. 23, 1976 Japan ..... 51-51677[U]

[51] Int. Cl.[2] ..... B32B 3/02

[52] U.S. Cl. ..... 428/62; 428/54; 428/61; 428/82; 428/95

[58] Field of Search ..... 428/62, 54, 82, 95, 428/61

[56] References Cited

U.S. PATENT DOCUMENTS 3,764,437 10/1973 Heimberger ..... 428/61

*Primary Examiner*—Marion E. McCamish

*Attorney, Agent, or Firm*—Bucknam and Archer

[57] ABSTRACT

A carpet construction comprises a plurality of square sheet materials butt-joined together to jointly provide a continuous planar upper surface. The sheet materials in each two adjacent rows are disposed in such a manner that the abutting lines of one of the two adjacent rows of sheet materials are disposed out of registration with those of the other. A plurality of stringer tapes are fixedly secured respectively to the lower marginal portions of the rows of sheet materials adjacent to their abutting ends and edges. Each opposed stringer tapes are coupled together to retain the sheet materials in butt-jointed condition. A plurality of connective members are secured respectively to rows of interengaged fastener elements of each mating stringer tapes immediately adjacent to the opposite ends thereof to retain the same in coupled condition.

5 Claims, 5 Drawing Figures

BUTT-JOINED CARPET CONSTRUCTION WITH STRINGER TAPES

BACKGROUND OF THE INVENTION

1. Field of the Invention

This invention relates to a carpet construction in which a plurality of sheet materials are butt-jointed together by means of slide fasteners to provide a continuous flat upper surface.

2. Prior Art

It has been known in the art to butt-joint a plurality of sheet materials by means of slide fasteners to provide a carpet or similar covering article including a sheet of artificial lawn, each of the slide fasteners comprising a pair of stringer tapes of the same length having rows of interengageable fastener elements on and along their confronting logitudinal edges, and secured respectively to opposed lower marginal portions of each adjacent sheet materials adjacent to their abutting ends or edges. These conventional covering constructions have been found not entirely satisfactory, however, in that extreme care must be exerted to position each pair of stringer tapes exactly in registration with each other so that they can be properly coupled together.

SUMMARY OF THE INVENTION

It is therefore an object of the present invention to provide a carpet construction comprising a plurality of sheet materials butt-jointed together by means of fastener stringer tapes secured respectively to lower marginal portions of the sheet materials adjacent to their abutting ends and edges, in which construction each mating stringer tapes do not need to be positioned exactly in registration with each other.

According to the invention, there is provided a carpet construction comprising a plurality of rows of square sheet materials butt-jointed together to jointly provide a continuous planar upper surface. The sheet materials in each row have the same width and are joined together end to end. Each two adjacent rows of sheet materials are butt-jointed together at one of their lateral edges. The sheet materials in each two adjacent rows are disposed in such a manner that the abutting lines of one of each adjacent rows of sheet materials are disposed out of registration with those of the other, respectively. A plurality of stringer tapes are fixedly secured respectively to the lower marginal portions of the plurality of rows of sheet materials adjacent their abutting ends and edges except for their opposite end portions. Each of the stringer tapes carries a row of fastener elements along one longitudinal edge thereof. The rows of fastener elements of the respective opposed stringer tapes are coupled together and hold the plurality of rows of sheet materials in butt-jointed condition. Each adjacent stringer tapes secured to each of the sheet materials have their one end portions disposed in partially overlapped relation. A plurality of means are secured respectively to the coupled fastener elements immediately adjacent to the end portions and positively hold the same in coupled relation.

Many other advantages and features of the present invention will become manifest to those versed in the art upon making reference to the detailed description and the accompanying sheets of drawings in which a preferred structural embodiment incorporating the principles of the present invention is shown by way of example.

DETAILED DESCRIPTION OF THE PREFERRED EMBODIMENT

Figure 1:
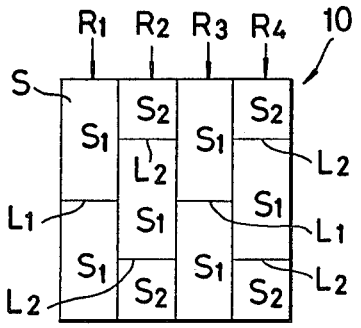
FIG. 1 is a top plan view of a carpet construction provided in accordance with the present invention.

FIG. 1 shows a carpet construction 10 which comprises a plurality of sheet materials S of the same width arranged in four rows R1 to R4 and butt-jointed together to jointly provide a continuous planar upper surface. Each of the first and third rows R1 and R3 comprises a pair of rectangular sheet materials S1 joined together end to end, and each of the second and fourth rows R2 and R4 comprises a pair of square sheet materials S2 and a rectangular sheet material S1 interposed therebetween and joined thereto in end to end relation. The rows of sheet materials S are butt-jointed together at one of their lateral edges. The arrangement of the rows of sheet materials is such that the abutting line L1 along which the respective pair of rectangular sheet materials S1, S1 in each of the first and third rows R1 and R3 are joined together is disposed out of registration with those L2 in each of the second and fourth rows R2 and R4.

Figure 2:
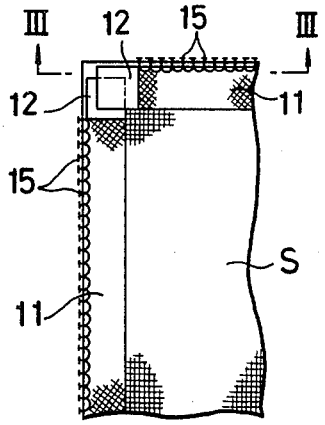
FIG. 2 is a fragmentary bottom view of the carpet construction.
Figure 3:
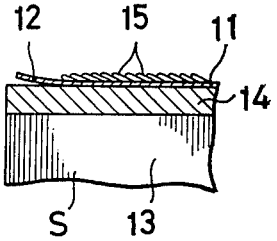
FIG. 3 is a fragmentary cross-sectional view of the carpet construction.

As shown in FIG. 2, a plurality of fastener stringer tapes 11 are adhesively bonded to or otherwise fixedly secured to the marginal portions of each of the sheet materials S adjacent to their abutting ends and edges except for their respective opposite end portions 12 (FIG. 3).

Figure 4:
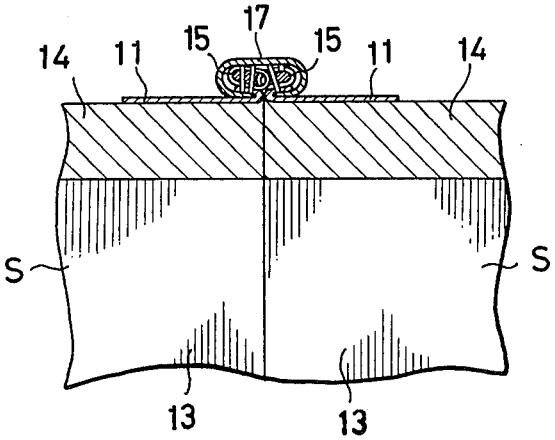
FIG. 4 is a fragmentary cross-sectional view of the carpet construction, showing adjacent sheet materials butt-jointed together.

As shown in FIG. 4, each of the sheet materials S comprises a napped fabric 13 and an undercushioning material 14 secured to the undersurface of the fabric 13. Each of the stringer tapes is secured to the undersurface of the associated undercushioning material 14 immediately adjacent to the respective abutting end or edge. Each of the stringer tapes 11 carries on and along one longitudinal edge a row of interengageable fastener elements 15. Each of the opposite end portions 12 is made rigid as by impregnating the same with a thermoplastic resin or by fusing a film of a thermoplastic resin thereto.

As shown in FIG. 2, the stringer tapes 11 secured to each adjacent marginal portions of each of the sheet materials S have their one end portions 12 disposed in partially overlapped relation.

Figure 5:
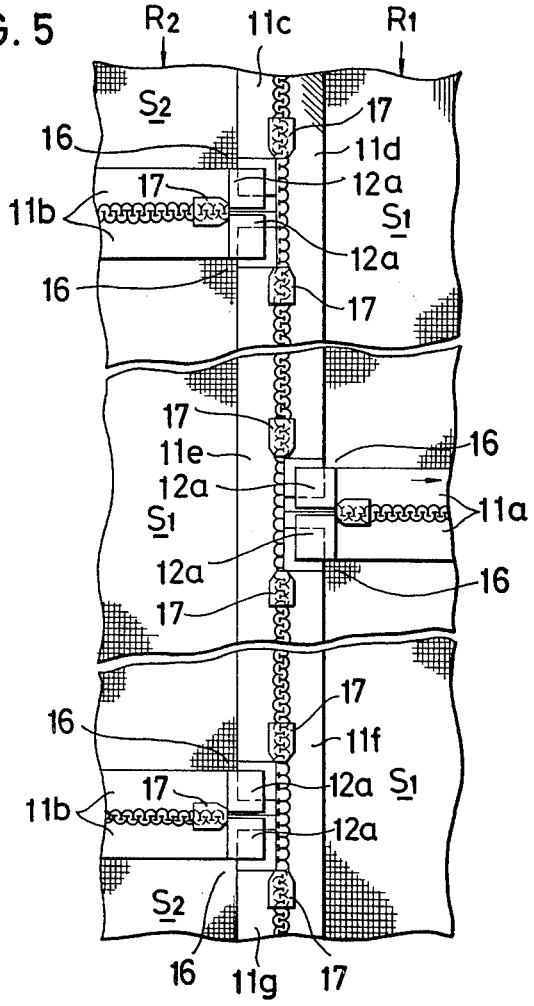
FIG. 5 is a fragmentary bottom view of the carpet construction, showing a plurality of sheet materials butt-jointed together.

The connecting operation of the stringer tapes 11 will now be fully described with reference to FIG. 5 which partially shows the undersurfaces of the sheet materials S in the first and second rows R1 and R2. Connection between each opposed stringer tapes 11 is made using a separate slider (not shown). The pair of stringer tapes **11*a*, 11*a* secured respectively to the opposed marginal portions of the sheet materials S1 and S1 in the first rows R1 are coupled together by first inserting their one end portions 12*a* through a guide channel of the slider and then moving it along the pair of rows of fastener elements 15 in a direction indicated by an arrow to interengage the same, thereby joining the mating sheet materials together. The slider is manipulated to move past the other end portions of the stringer tapes 11***a*, 11*a*. Similarly, the two pairs of stringer tapes 11*b* attached to the opposed marginal portions of the sheet materials S1 and S2 in the second row R2 are coupled together by the slider, respectively.

Also, similarly, the first and second rows of sheet materials R1, R2 are butt-jointed together at one of their edges. The slider is manipulated to move along the fastener elements 15 of the stringer tapes 11*c* to 11*g*. It is important to note that the stringer tape 11*d* is coupled to the stringer tapes 11*c* and 11*e* and that the stringer tape 11*f* is coupled to the stringer tapes 11*e* and 11*g*. This arrangement greatly improves the ability of the stringer tapes 11*c* to 11*g* to keep the butt-jointed sheet materials in the first and second rows R1 and R2 flat to provide a continuous planar upper surface. Thus, the possibility of the corners 16 of the sheet materials S warping upwardly is substantially eliminated.

A plurality of connective members 17 are fixedly secured to the interengaged fastener elements 15 closely adjacent to their respective end portions 12 to retain the mating stringer tapes 11 in coupled condition, each of the connective members 17 comprising a sheet of a flexible material, such as metal or a synthetic resin, embracing the joint periphery of the interengaged fastener elements 15 as shown in FIG. 4.

Since each pair of mating stringer tapes 11 do not need to be positioned exactly in registration with each other as is the case with a slide fastener of the general type having end stop members and/or a pin and box member, replacement of a damaged sheet material with a new one can be carried out with utmost ease and speed.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A carpet construction comprising:

(a) a plurality of rows of square sheet materials butt-jointed together to jointly provide a continuous planar upper surface, said sheet materials in each row having the same width and being joined together end to end, each two adjacent rows of sheet materials being butt-jointed together at one of their lateral edges, and said sheet materials in said each two adjacent rows being disposed in such a manner that the abutting lines of one of each adjacent rows of sheet materials are disposed out of registration with those of the other, respectively;

(b) a plurality of stringer tapes fixedly secured respectively to the lower marginal portions of said plurality of rows of sheet materials adjacent their abutting ends and edges except for their opposite end portions, each of said stringer tapes carrying a row of fastener elements along one longitudinal edge thereof, said rows of fastener elements of the respective opposed stringer tapes being coupled together and holding said plurality of rows of sheet materials in butt-jointed condition, and each adjacent stringer tapes secured to each of said sheet materials having their one end portions disposed in partially overlapped relation; and (c) a plurality of means secured respectively to said coupled fastener elements immediately adjacent to said end portions and positively holding the same in coupled relation.

2. A carpet construction according to claim 1, in which each of said means comprises a sheet of flexible material embracing a respective one of said coupled fastener elements.

3. A carpet construction according to claim 1, in which each of said end portions of said stringer tapes is made rigid.

4. A carpet construction according to claim 3, in which each of said end portions is impregnated with a thermoplastic resin.

5. A carpet construction according to claim 3, in which a film of a thermoplastic resin is fused to each of said end portions of said stringer tapes.

* * * * *